United States Patent [19]

Ewalt et al.

[11] 4,175,986

[45] Nov. 27, 1979

[54] INERT CARRIER GAS HEAT TREATING CONTROL PROCESS

[75] Inventors: Leonard J. Ewalt, Lafayette, Ind.; Som N. Kaushal, Lebanon, Tenn.

[73] Assignee: TRW Inc., Cleveland, Ohio

[21] Appl. No.: 952,657

[22] Filed: Oct. 19, 1978

[51] Int. Cl.[2] ..... C21D 1/48

[52] U.S. Cl. ..... 148/16.5; 148/16.6; 148/16.7

[58] Field of Search ..... 148/16.5, 16.6, 16.7

[56] References Cited

U.S. PATENT DOCUMENTS

| | | | |
|---|---|---|---|
| 4,035,203 | 7/1977 | L'Hermite et al. | 148/16.6 |
| 4,049,472 | 9/1977 | Arndt | 148/16 |
| 4,049,473 | 9/1977 | Davis et al. | 148/16.5 |
| 4,108,693 | 8/1978 | L'Hermite et al. | 148/16.5 |

OTHER PUBLICATIONS

*Metal Progress*, "Nitrogen as a Carrier Gas in Gas Carburizing", Holcroft et al., Feb. 1948, pp. 241–246.

*Materials Progress*, "Carburizing with Nitrogen at Detroit Diesel Allison", Oct. 1977, pp. 9–11, and Jun. 1978, p. 96.

*Primary Examiner*—L. Dewayne Rutledge

*Assistant Examiner*—John P. Sheehan

[57] ABSTRACT

Ferrous articles are heat treated by introducing a gaseous carbon source and an inert carrier gas into a heat treating furnace containing the ferrous articles. The heat treating process is controlled by determining the amount of carbon monoxide resulting from reactions in the furnace and controlling the amount of inert carrier gas in the furnace in response to the amount of carbon monoxide in the furnace atmosphere to control the carbon potential to a desired level by minimizing the effect of equilibrium reactions. Best results are achieved when the amount of carbon monoxide is less than about 3%, preferably, less than about 1%, by volume. Controlling the carbon monoxide level will minimize the effect of harmful decarburizing agents (oxygen, carbon dioxide and water vapor). Under the reaction conditions existing within the furnace operated in accordance with the present invention, hydrocarbon dissociation reaction and primary carburizing reaction are nonequilibrium reactions and control the process results. Oxidation reactions, secondary carburizing reaction and hydrogen decarburizing reaction are equilibrium reactions but are minimized when the inert carrier gas level within the furnace is used to control the carbon monoxide level, especially less than about 3%, preferably less than about 1.0% by volume. Carburizing is a preferred heat treating process and can be carried out using a hydrocarbon source such as methane and an inert carrier gas such as nitrogen.

25 Claims, 3 Drawing Figures

INERT CARRIER GAS HEAT TREATING CONTROL PROCESS

BACKGROUND OF THE INVENTION

I. Field of the Invention

The present invention relates to the heat treating of ferrous articles. In particular, the present invention relates to a heat treating control process wherein ferrous articles are treated in a mixture of a gaseous carbon source and an inert carrier gas.

II. Description of Prior Art

Copies of the following prior art references were appended to the original application papers and discussed in a Prior Art Statement.

L'Air U.S. Pat. No. 4,035,203. This patent discloses a process which introduces nitrogen and methane into a heat treating furnace and has an analyzer for the methane level within the furnace. The methane level within the furnace is automatically regulated in response to the analyzer. The L'Air process does not measure, analyze or control the level of decarburizing agents in the furnace. Also, L'Air process does not control the carbon monoxide level of the furnace.

Air Products U.S. Pat. No. 4,049,472. This patent discloses a process wherein a gaseous mixture is prepared at ambient temperatures and introduced into the furnace. The gaseous mixture comprises: 62–98% nitrogen, 1.5–30% methane (natural gas), 0.2–15% carbon dioxide and 0–10% ammonia (if carbonitriding).

The carbon potential within the furnace is determined according to a ratio of methane to carbon dioxide. The patent process requires a certain level of carbon dioxide to control the carbon potential within the furnace. This is a disadvantage since carbon dioxide is a strong decarburizing agent. No attempt is made to control the level of other decarburizing agents (oxygen and water vapor) within the furnace. Carbon monoxide levels are not measured.

Airco U.S. Pat. No. 4,049,473. Nitrogen is introduced during the Airco process only to the furnace vestibule, although nitrogen may be introduced into the furnace proper prior to carburizing to act as a purge. A hydrocarbon source such as methane is introduced into the furnace proper without a carrier gas. The carbon potential (i.e., the level of carbon in all compounds such as carbon monoxide and methane) is measured by an electric resistance wire which controls the introduction of natural gas into the furnace. The total carbon present within the furnace is measured—including the carbon in decarburizing agents such as carbon dioxide. Hence, the Airco process fails to analyze or control the level of decarburizing agents within the furnace. In fact, an affidavit filed by the applicants during the prosecution of this patent reveals that decarburizing agents such as oxygen contained in air must be specifically introduced into the furnace proper as an "adjustment" to assure that substantially all of the methane is reacted to avoid sooting.

Metal Progress (February, 1948, pages 241–246). This article discusses a furnace atmosphere created by the introduction of nitrogen and methane wherein the carbon monoxide level would be less than or about 1% and the carbon dioxide level would be essentially zero. See page 244. However, the article concludes that a measurable level of carbon dioxide is necessary to control the process. See pages 244 and 246. The article does not suggest that the nitrogen flow rate could be used to control the level of strong decarburizing agents which may, for example, result from air leaks into the furnace.

Metal Progress (October, 1977, pages 9–11 and June, 1978, page 96). The article discloses a heat treating process utilizing nitrogen and methane, the methane level being controlled by a methane analyzer. The accompanying letter to the editor raises a problem of controlling the decarburizing agents that may exist in the furnace atmosphere which leads to a large variation in the levels of carbon monoxide in the furnace atmosphere. However, no solution was offered for that problem, nor is the nitrogen flow controlled to maintain the control of carbon monoxide.

SUMMARY OF THE INVENTION

The present invention relates to a method of heat treating ferrous articles in a heat treating furnace containing a mixture of a gaseous carbon source and an inert carrier gas. Specifically, it concerns a method of controlling the heat treating process by determining the amount of carbon monoxide in the furnace atmosphere and controlling the amount of inert carrier gas in the furnace in response to the amount of carbon monoxide to control the carbon potential to a desired level by minimizing the effect of equilibrium reactions. Best results are achieved when the amount of carbon monoxide is less than about about 3%, preferably, less than about 1%, by volume. Controlling the carbon monoxide level will minimize the effect of harmful decarburizing agents (such as carbon dioxide, oxygen and water vapor) and the effect of unwanted equilibrium reactions, such as oxidation and secondary carburizing reactions. The heat treating process of the present invention is controlled by nonequilibrium reactions (primary carburizing and hydrocarbon dissociation reactions) so that the carbon potential or level achieved on the ferrous articles is a function of time and temperature.

The present invention uses a conventional production heat treat furnace and closely controls the carburizing and decarburizing reactions so that the heat treating process is more accurately reproducible and therefore consistent from one heat treating cycle to the next. The process also accurately controls the decarburizing agents and aids in the efficient use of the gaseous carbon source. Other advantages of the present invention include reduced grain boundry oxidation, improved carbon gradient, and case hardenability.

Many heat treating processes can use the present invention. For example, the present invention can be used in carburizing or neutral hardening processes and also in carbonitriding where an available nascent nitrogen source such as ammonia is added to the furnace atmosphere. Normalizing and annealing can also be controlled by the present invention.

The ferrous articles can be processed in either a batch or continuous furnace which are known in the art and need not be explained herein. Preferably, the gaseous carbon source and the inert carrier gas are continuously introduced into the furnace whether a continuous or batch furnace is employed.

The gaseous carbon source and carbon monoxide levels within the furnace atmosphere can be continuously monitored by conventional gas analyzers which in turn generate a signal to regulate the flow of the gaseous carbon source and inert carrier gas into the furnace atmosphere. Alternatively, the flow rates of the gaseous carbon source and the inert carrier gas can be adjusted manually.

Several materials can be used for the gaseous carbon source and the inert carrier gas, but natural gas (substantially methane) and nitrogen are preferrred because of their availability and cost. However, other materials can be employed as explained in more detail below.

DETAILED DESCRIPTION OF INVENTION

Figure 1:
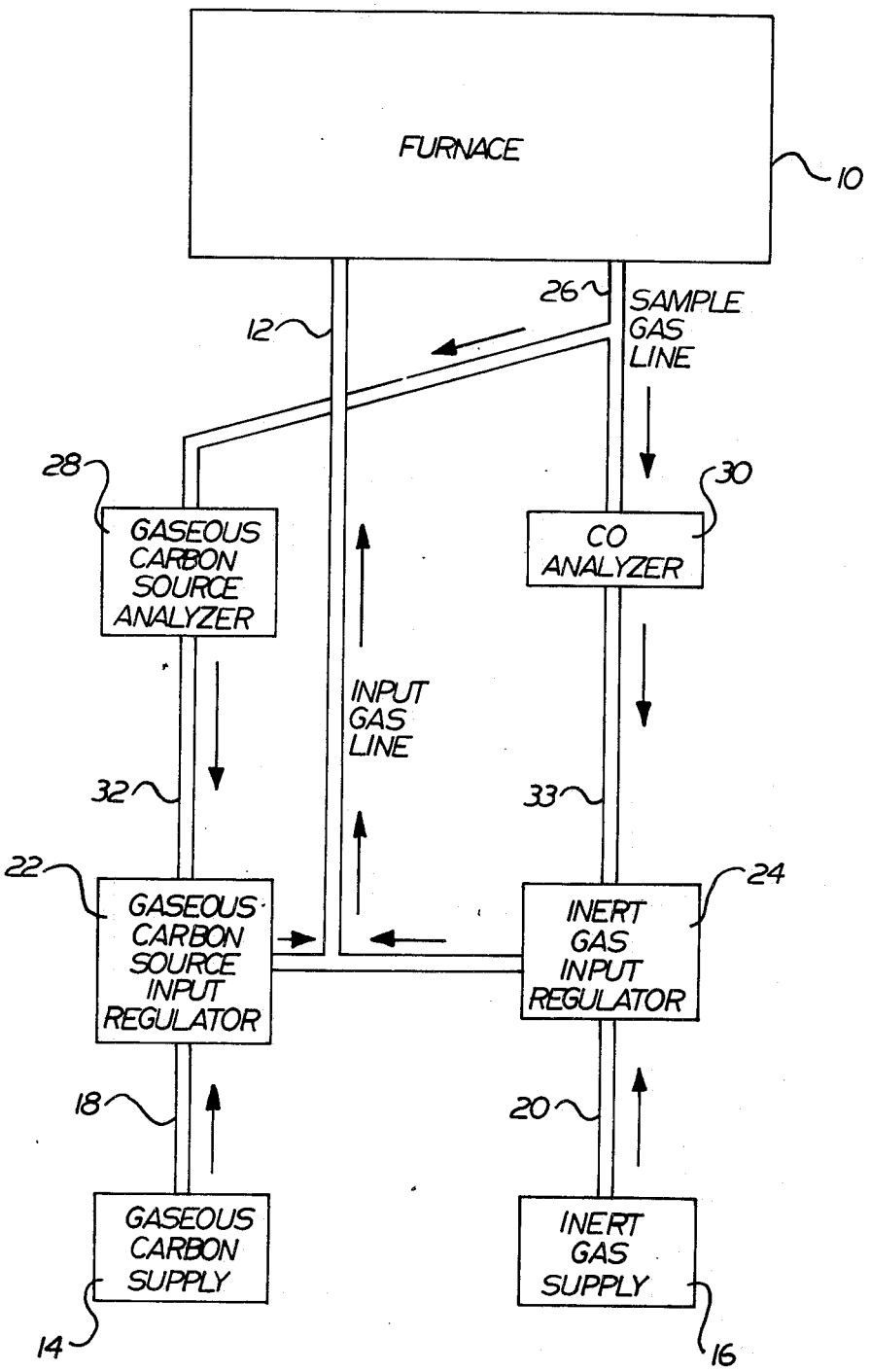
FIG. 1 is a schematic illustration of apparatus for the control process of the present invention.

With reference to FIG. 1, the process of the present invention can be performed in an atmosphere heat treating furnace 10 which may be either a batch or continuous furnace known in the art. A gaseous carbon source and an inert carrier gas are introduced into the furnace through an input gas line 12 to create the desired furnace atmosphere. The gaseous carbon source and the inert gas may be derived from suitable supplies 14, 16 and fed into the furnace through input gas line 12 through their respective supply lines 18, 20 and input regulator valves 22, 24. The atmosphere existing within the furnace can be analyzed by drawing off a small sample of the atmosphere through a sample gas line 26. The furnace gas sample is analyzed, and the levels of the gaseous carbon source and carbon monoxide existing within the furnace are determined by analyzers 28, 30.

The amount of gaseous carbon source introduced into the furnace through input gas line 12 is controlled by the regulator valve 22 in response to the gaseous carbon source level determined by the gaseous carbon source analyzer 28. A control line 32 schematically represents the control linkage between the gaseous carbon source analyzer 28 and the gaseous carbon source input regulator 22. Similarly, the inert carrier gas flowing into the furnace through the input gas line 12 is controlled through inert carrier gas input regulator 24 in response to the carbon monoxide analyzer 30. Again, a control line 33 schematically represents the control linkage between the carbon monoxide analyzer 30 and the inert carrier gas input regulator 24. Of course, additional analyzers can be employed to detect the levels of other constituents within the furnace. For example, the level of carbon dioxide can be monitored.

Utilization of the foregoing apparatus in the process of the present invention is better understood with knowledge of the chemical reactions taking place within the furnace.

Introduction of the gaseous carbon source into the elevated temperatures existing within the furnace results in dissociation of the gaseous carbon source into its constituent elements. Thus, if methane is employed as the gaseous carbon source, either in its substantially pure form or as natural gas, the following dissociation reaction takes place:

$$CH_4 \rightarrow C + 2H_2$$

The dissociation reaction is responsible for supplying active carbon to a ferrous article for introducing carbon onto the surface of the ferrous article. This reaction is controlled by keeping the analyzed level of unreacted gaseous carbon source (such as methane) to a desired percentage by controlling the gaseous carbon source input into the furnace, such as by analyzers and suitable servomechanisms.

Introduction of carbon onto the surface of the ferrous article in the process of the present invention is accomplished through the following carburizing reaction:

$$3Fe + C \dashrightarrow Fe_3C$$

(Gaseous carbon source dissociation)

Primary carburization begins with cementite ($Fe_3C$) formation at the surface of the ferrous article which produces unidirectional carbon diffusion. Carbon diffusion is controlled by a time/temperature relationship governed by solid state diffusion laws.

Although oxygen is not intentionally introduced into the furnace in the present invention, oxygen can and does get into the furnace. Oxygen can get into the furnace through air leakage and through oxides on the surface of the ferrous articles introduced into the furnace. With the unintentional but unavoidable introduction of oxygen into the furnace atmosphere, the following oxidation reactions take place:

$$2CH_4 + O_2 \rightarrow 2CO + 4H_2$$

$$2CH_4 + 4O_2 \rightarrow 2CO_2 + 4H_2O$$

$$H_2O + CO \rightarrow H_2 + CO_2$$

$$H_2O + CH_4 \rightarrow CO + 3H_2$$

Carbon monoxide, carbon dioxide and water vapor in the furnace atmosphere indicate the presence of oxygen in the furnace through air leakage and surface oxides. However, oxygen, carbon dioxide and water vapor are all strong decarburizing agents which, of course, is counterproductive to the non-equilibrium carburizing reaction. Thus, oxygen, carbon dioxide and water vapor all represent chemicals which can react with the iron carbide (cementite) already formed on the surface of a ferrous article to form iron. Additionally, oxygen, carbon dioxide and water vapor are also oxidizing agents—oxygen and carbon dioxide being strongly oxidizing. Thus, oxygen, carbon dioxide and water vapor can react with the iron on the surfaces of the ferrous articles to form iron oxide.

Carbon monoxide is a weak carburizing agent and carbon contributed by it would combine with Fe to form a solid solution (Fe(C)) on the surface of the ferrous articles. Such a secondary carburizing reaction can be illustrated as follows:

$$2CO + Fe \rightarrow Fe(C) + CO_2$$

The reactions taking place within the furnace are such that the level of harmful decarburizing agents (oxygen, carbon dioxide and water vapor) will be essentially zero if the carbon monoxide level is less than 1% by volume at the prevailing temperatures and pressures within the furnace. Preferably, the carbon monoxide level is less than about 1%, since the degree of control of carbon potential decreases as the carbon monoxide level increases beyond 1%. Above about 3% the equilibrium reactions tend to have a significant influence on the atmosphere composition such that the process can no longer be considered under the control of only the desired non-equilibrium reactions.

Higher carbon monoxide levels can be tolerated during the initial stages of the heat treating process than during the final stages because the diffusion of the iron carbide into ferrous material is governed by unidirectional solid state diffusion laws. For example, ferrous articles have been carburized by being subjected to the process of the present invention using a decreasing carbon monoxide level of 1.6% down to 0.8% over an eight hour period. The preferred level of below about 1% carbon monoxide was not reached until half way through the period, but the process still possessed the necessary degree of conrol because of the low carbon monoxide levels in the later stages of the process.

Thus, controlling the flow of nitrogen into the furnace in response to the analyzed level of carbon monoxide level within the furnace will result in accordance with the present invention with the maintenance of the desired carbon potential. The levels of harmful decarburizing agents (carbon dioxide, oxygen and water vapor) will be minimized through indirect control by the inert gas. The control of the inert carrier gas flow can be accomplished automatically by using an analyzer, such as an infrared analyzer, and a suitable servomechanism.

The gaseous carbon source will usually be introduced into the furnace to achieve about 5–30% by volume of gaseous carbon source at the prevailing furnace temperatures and pressures. The preferred level is about 5–20%, while most commercial products can be processed at about 10–18%. The inert carrier gas is introduced as the balance of the input gas with the gaseous carbon source at a flow rate to maintain the desired level of carbon monoxide. Best results are achieved when carbon monoxide is less than about 3%, preferably less than about 1%. Of course, when carbonitriding an available nascent nitrogen source such as ammonia would also be introduced.

The only other significant compound to be considered in the reaction processes of the present invention is hydrogen which under certain circumstances can be a decarburizing agent in the following reaction:

$$Fe_3C + 2H_2 \rightarrow 3Fe + CH_4$$

However, this reaction is only significant if the volume of hydrogen is rather large. For the temperatures and pressures involved in the heat treating process of the present invention, the volume of hydrogen would have to be greater than 30% for the reaction to be significant. Since the volume of hydrogen produced in the process of the present invention is relatively small, the decarburizing effect of hydrogen is not significant.

Under the reaction conditions existing within the furance operated in accordance with the present invention, the hydrocarbon dissociation reaction and the primary carburizing reaction noted above are nonequilibrium reactions and control the process results. The oxidation reactions, the secondary carburizing reaction and the hydrogen decarburizing reaction noted above are equilibrium reactions but are minimized when the inert carrier gas level within the furnace is used to control the carbon monoxide level, especially less than about 3%, preferably less than about 1.0% by volume.

With the process of the present invention being controlled by nonequilibrium reactions, the carbon potential or level achieved on ferrous articles is a function of time and temperature, that is, the longer an article remains in a furnace, the more carbon is diffused into the article. Prior art processes controlled by equilibrium reactions have an upper carbon potential since once equilibrium is achieved, the carbon potential or level of the article cannot be further increased under the same conditions despite increased time in the furnace.

Figure 2:
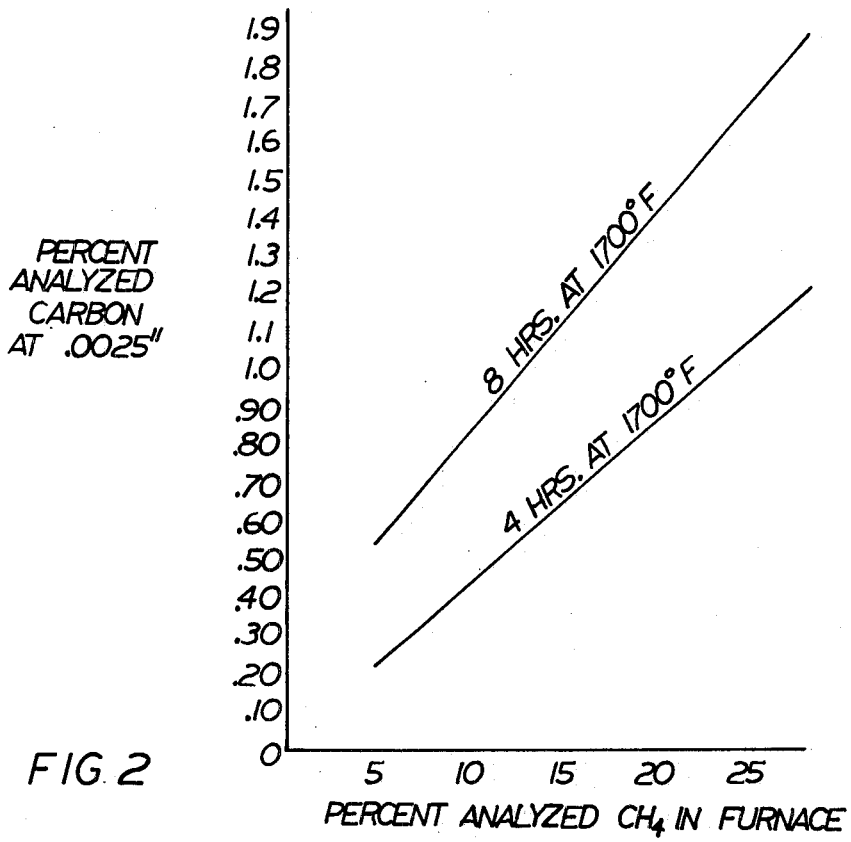
FIG. 2 is a graph showing the relationship of surface carbon weight percent with time on parts carburized with the present invention.
Figure 3:
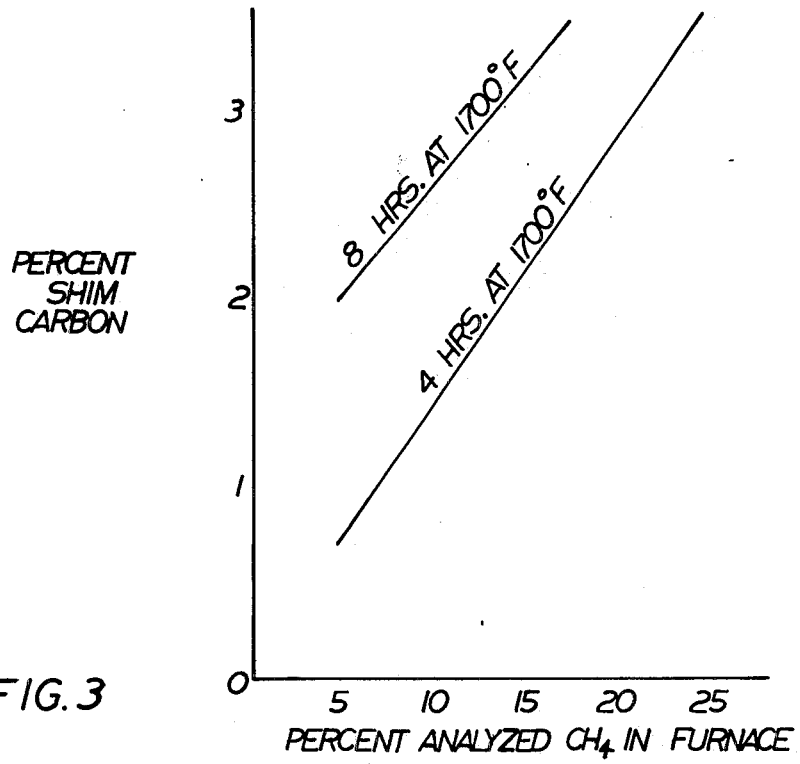
FIG. 3 is a graph showing the relationship of the percentage of carbon absorbed by 0.005" thick shim stock carburized in the process of the present invention.

The control of the present invention by nonequilibrium reactions is illustrated by FIGS. 2 and 3. FIGS. 2 and 3 show that maintaining ferrous articles for a longer time in the furnace will result in higher carbon potentials and that increasing the carbon levels in the furnace will also result in higher carbon potentials. FIG. 2 graphs the percentage of analyzed carbon at 0.0025" (i.e., the median of the first 0.005") versus the percentage of analyzed methane in the furnace for 4 and 8 hours at 1700° F. (927° C.). FIG. 3 is a similar graph for the percentage of carbon in a 0.005" shim.

The process control as described above can be utilized with a variety of heat treating processes. For example, the process of the present invention can be utilized with carbonitriding, carburizing, neutral hardening, normalizing and annealing. Carburizing, of course, is the introduction of carbon into the surface of a ferrous metal article. Carbonitriding is the process of introducing available nitrogen and carbon onto the surface of the ferrous metal article. To utilize the present invention to control a carbonitriding process, ammonia can be added to the gaseous mixture introduced into the furnace. The ammonia can be introduced at a fixed or variable rate to achieve a furnace atmosphere content of about 0–10% ammonia by volume. In such a process, the carbon monoxide level is maintained at the desired level, such as below about 3%, preferably less than about 1%, by controlling the nitrogen flow rate into the furance.

The control process of the present invention can also be used for neutral hardening. Neutral hardening is a heat treating process where the furnace atmosphere is selected so that net carbon is neither added nor taken away from the surface of the ferrous metal articles. Again, the control process of the present invention is utilized to maintain carbon monoxide at the desired level and the gaseous carbon source would be monitored to create available carbon sufficient to keep the ferrous metal articles at the carbon level at which they are introduced into the furnace.

The input flow control for the various gases introduced into the furnace has been described as being automatically controlled in response to the detected levels, but it will be apparent that the flow could be varied manually in response to the detected levels. Manual control can be continued throughout the process cycle, but after initial adjustment or variation of the inert carrier gas to obtain the desired carbon monoxide level further adjustments or variations for the inert gas flow may not be necessary. As noted above, batch or continuous furnaces can be utilized.

The gaseous carbon source may be any suitable material to supply the necessary level of carbon within the furnace. Gaseous hydrocarbon sources are preferred. Natural gas (substantially methane), methane and propane are preferred, especially natural gas, because of their cost and availability. However, other gaseous hydrocarbon sources can be used such as ethane, butane, acetylene, ethylene and vaporized hydrocarbon fuels.

The inert carrier gas can be any gaseous material which can act as an inert carrier gas for the reactant materials. Nitrogen is preferred because of its availability and cost, but other inert carrier gases can be utilized such as helium, neon, argon, etc.

Temperatures utilized for heat treating processes of ferrous materials are well known and are generally within the range of about 1450° F. (788° C.) to about 1950° F. (1066° C.). For carburizing, temperatures existing within the furnace are generally within the range of about 1650° F. (899° C.) to about 1725° F. (941° C.), particularly at about 1700° F. (927° C.). For carbonitriding, temperatures tend to be in the range of about 1450° F. (788° C.) to about 1600° F. (871° C.). Furnace pressures are conventional, i.e., slightly above atmospheric pressure to minimize air leakage.

The process of the present invention as related to carburizing can be divided into four phases: (1) conditioning of the furnace prior to loading, (2) loading the furnace and returning to operating temperature, (3) carburizing, and (4) reducing the furnace temperature prior to quenching and quenching of the load.

The process of the present invention has been utilized in the following manner to carburize a variety of ferrous articles such as rack pistons, gear shafts and worm screws. The furnace was conditioned prior to loading by bringing the furnace to operating temperature and introducing nitrogen and a small amount of hydrocarbon into the furnace until the carbon monoxide level was below 1%. Sufficient atmosphere flow was used to maintain positive furnace pressure. The hydrocarbon addition was cut off just prior to loading. The furnace was then loaded and brought back to operating temperature. During this period only nitrogen was added to the furnace atmosphere and the carbon monoxide level was maintained less than about 1%. Upon reaching operating temperature a sufficient flow of hydrocarbon was introduced into the furnace to maintain the desired level of analyzed hydrocarbon, and a nitrogen flow was maintained to keep the level of carbon monoxide less than about 1%. Carburizing time was maintained consistent with the case depth required. Carbon potential was controlled by (a) the analyzed hydrocarbon percentage consistent with total carburizing time, (b) nitrogen flow to maintain the analyzed level of carbon monoxide less than 1%, and (c) diffusion time as necessary to achieve the deisred metallographic characteristics of the carburized case. At the completion of the carburizing cycle the furnace temperature was reduced to 1550° F. During this period the hydrocarbon additive was cut off and nitrogen flow maintained to keep the level of carbon monoxide less than about 1%. The load was then quenched. Instrumentation for analyzing the furnace atmosphere consisted of an Infrared Industries M 7035-026 analyzer for carbon monoxide and an Infrared Industries M 702060 analyzer for methane.

EXAMPLE

The process of the present invention was utilized in the following manner to carburize a mixed load of 100 rack pistons and gear shafts:

(1) Conditioning The furnace was conditioned at 1700° F. for 2½ hours with a nitrogen ($N_2$) flow of 400 CFH (cubic feet per hour) and a methane ($CH_4$) flow of 100 CFH. After 2½ hours the analyzed atmosphere was carbon monoxide (CO)—0.4%, methane ($CH_4$)—15.6%, and carbon dioxide ($CO_2$)—0.033%.

(2) Loading The furnace was loaded. Atmosphere flows were nitrogen ($N_2$)—1000 CFH, methane ($CH_4$)—0 CFH.

(3) Carburizing—Diffusion The furnace load was carburized at 1700° F. for 6 hours. Gas flows were nitrogen ($N_2$)—360 CFH, methane ($CH_4$)—85 CFH. Analyzed atmosphere carbon monoxide (CO)—0.4%, methane ($CH_4$)—15%, carbon dioxide ($CO_2$)—0.024%.

The furnace load was diffused at 1700° F. for 2 hours. Gas flows were nitrogen ($N_2$)—360 CHF, methane ($CH_4$)—0 CFH. Atmosphere analyzed carbon monoxide (CO)—0.1%, methane ($CH_4$)—0%, carbon dioxide ($CO_2$)—0.001%.

(4) Temperature reduction—Quenching The temperature of the furnace load was reduced to 1550° F. and allowed to equalize for 1 hour. The load was then quenched. Gas flows were nitrogen ($N_2$)—400 CFH, methane ($CH_4$)—0 CFH. Analyzed atmosphere was carbon monoxide (CO)—0.1%, methane ($CH_4$)—0%, carbon dioxide ($CO_2$)—0.003%.

The furnace was then ready to be conditioned for the next load.

The parts processed were determined to have a surface hardness of 60/61 Rockwell C, a total case depth of 0.070" and an effective case depth (to 50 Rockwell C) of 0.063". The following hardness and carbon gradients were determined:

| Hardness | | Carbon | |
|---|---|---|---|
| Distance from Surface | Rockwell C | Distance from Surface | Carbon Wt.% |
| 0.003" | 61 | 0.0025" | 0.958 |
| 0.005 | 61 | 0.0075 | 0.925 |
| 0.010 | 61 | 0.0125 | 0.906 |
| 0.020 | 60.7 | 0.0175 | 0.843 |
| 0.030 | 61.4 | 0.0225 | 0.794 |
| 0.040 | 59 | 0.0275 | 0.731 |
| 0.050 | 55.8 | 0.0325 | 0.659 |
| 0.060 | 51.1 | 0.0375 | 0.577 |
| 0.065 | 49.2 | 0.0425 | 0.514 |
| 0.070 | 46 | 0.0475 | 0.426 |
| | | 0.0550 | 0.344 |
| | | 0.0650 | 0.279 |
| | | 0.0750 | 0.260 |
| | | 0.0850 | 0.236 |
| | | 0.0950 | 0.213 |

What is claimed is:

1. A method of heat treating ferrous articles comprising introducing a gaseous carbon source and an inert carrier gas into a heat treating furnace containing ferrous articles being heat treated in a furnace atmosphere containing carbon monoxide, determining the amount of carbon monoxide in the furnace atmosphere, and controlling the flow of inert carrier gas into the furnace to maintain the amount of carbon monoxide in the furnace atmosphere below about 3% by volume to control the carbon potential to a desired level by minimizing the effect of equilibrium reactions.

2. A method of heat treating as claimed in claim 1 wherein the amount of carbon monoxide is maintained below about 1% by volume.

3. A method of heat treating as claimed in claim 1 including the steps of measuring the amount of gaseous carbon source in the furnace atmosphere and controlling the amount of gaseous carbon source in the furnace to maintain the gaseous carbon source at a predetermined amount.

4. A method of heat treating as claimed in claim 1 wherein the gaseous carbon source is selected from the group consisting of natural gas, methane and propane.

5. A method of heat treating as claimed in claim 4 wherein the gaseous carbon source is natural gas.

6. A method of heat treating as claimed in claim 1 wherein the inert carrier gas is selected from the group consisting of nitrogen, helium, neon and argon.

7. A method of heat treating as claimed in claim 6 wherein the inert carrier gas is nitrogen.

8. A method of heat treating as claimed in claim 1 wherein the heat treating process being conducted is selected from the group consisting of carbonitriding, carburizing, neutral hardening, normalizing and annealing.

9. A method of heat treating as claimed in claim 8 wherein the process being conducted is carburizing.

10. A method of heat treating as claimed in claim 1 wherein the gaseous carbon source and the inert carrier gas are continuously introduced into the furnace.

11. A method of heat treating as claimed in claim 10 wherein the flow rate of the inert carrier gas is varied to maintain the amount of carbon monoxide in the furnace less than about 3% by volume.

12. A method of heat treating as claimed in claim 10 wherein the flow rate of the inert carrier gas is varied to maintain the amount of carbon monoxide in the furnace less than about 1% by volume.

13. A method of heat treating as claimed in claim 10 including the steps of generating a control signal indicative of the amount of carbon monoxide in the furnace atmosphere and controlling the amount of inert carrier gas introduced into the furnace in response to said control signal to maintain the amount of carbon monoxide less than about 1%.

14. A method of heat treating as claimed in claim 10 including the steps of generating a control signal indicative of the amount of gaseous carbon source in the furnace atmosphere and controlling the amount of gaseous carbon source introduced into the furnace in response to said control signal to maintain the gaseous carbon source at a predetermined amount.

15. A method of heat treating as claimed in claim 1 wherein the furnace atmosphere is at a temperature within the range of about 1450° F. to about 1950° F. and the gaseous carbon source is about 5% to about 30% by volume of the furnace atmosphere.

16. A method of heat treating ferrous articles comprising flowing a gaseous mixture comprising methane and nitrogen into a heat treating furnace containing ferrous articles being heat treated in a heat treating furnace atmosphere containing carbon monoxide and containing about 5% to about 30% by volume methane, maintaining a temperature within the range of about 1450° F. to about 1950° F., measuring the amount of methane in the furnace atmosphere, measuring the amount of carbon monoxide in the furnace atmosphere, controlling the flow of methane into the furnace to maintain the amount of methane at a predetermined amount, and controlling the flow of nitrogen into the furnace to maintain the amount of carbon monoxide in the furnace atmosphere below about 3% by volume to control the carbon potential to a desired level by minimizing the effect of equilibrium reactions.

17. A method of heat treating as claimed in claim 16 wherein the amount of carbon monoxide is maintained below about 1% by volume.

18. A method of heat treating ferrous articles comprising flowing a gaseous carbon source and an inert carrier gas into a heat treating furnace containing ferrous articles, maintaining the temperature of the furnace atmosphere in the range of about 1450° F. to about 1950° F., measuring the amount of carbon monoxide in said furnace atmosphere, measuring the amount of gaseous carbon source in said furnace atmosphere, changing the amount of gaseous carbon source flowing into the furnace to maintain the amount of gaseous carbon source in the furnace at a predetermined amount within the range of about 5% to about 30% by volume of the furnace atmosphere, and changing the amount of inert carrier gas flowing into the furnace to maintain the amount of carbon monoxide in the furnace atmosphere below about 3% by volume to control the carbon potential to a desired level by minimizing the effect of equilibrium reactions.

19. A method of heat treating as claimed in claim 18 wherein the amount of carbon monoxide is maintained below about 1% by volume.

20. A method of heat treating as claimed in claim 18 wherein the gaseous carbon source is selected from the group consisting of natural gas, methane and propane.

21. A method of heat treating as claimed in claim 20 wherein the gaseous carbon source is natural gas.

22. A method of heat treating as claimed in claim 18 wherein the inert carrier gas is selected from the group consisting of nitrogen, helium, neon and argon.

23. A method of heat treating as claimed in claim 22 wherein the inert carrier gas is nitrogen.

24. A method of heat treating as claimed in claim 18 wherein the heat treating process being conducted is selected from the group consisting of carbonitriding, carburizing, neutral hardening, normalizing and annealing.

25. A method of heat treating as claimed in claim 24 whrein the process being conducted is carburizing.

* * * * *